US010064528B1

(12) United States Patent
Ebrahimi Afrouzi et al.

(10) Patent No.: US 10,064,528 B1
(45) Date of Patent: Sep. 4, 2018

(54) DEBRIS COMPACTING SYSTEM FOR ROBOTIC VACUUMS

(71) Applicants: Ali Ebrahimi Afrouzi, San Jose, CA (US); Soroush Mehrnia, Copenhagen (DK)

(72) Inventors: Ali Ebrahimi Afrouzi, San Jose, CA (US); Soroush Mehrnia, Copenhagen (DK)

(73) Assignee: AI Incorporated, Toronto (CA)

( * ) Notice: Subject to any disclaimer, the term of this patent is extended or adjusted under 35 U.S.C. 154(b) by 265 days.

(21) Appl. No.: 14/887,542

(22) Filed: Oct. 20, 2015

Related U.S. Application Data

(60) Provisional application No. 62/066,881, filed on Oct. 21, 2014.

(51) Int. Cl.
*A47L 9/10* (2006.01)
*A47L 9/12* (2006.01)
*A47L 5/22* (2006.01)

(52) U.S. Cl.
CPC ..... *A47L 9/108* (2013.01); *A47L 5/22* (2013.01); *A47L 9/12* (2013.01); *A47L 2201/00* (2013.01)

(58) Field of Classification Search
CPC ... A47L 9/108; A47L 9/12; A47L 5/22; A47L 2201/00; A47L 2201/024
See application file for complete search history.

(56) References Cited

U.S. PATENT DOCUMENTS

2006/0048491 A1* 3/2006 Pineschi ..... A47L 5/362 55/428
2006/0123749 A1* 6/2006 Park ..... A47L 9/108 55/428
2008/0263816 A1* 10/2008 Oh ..... A47L 9/108 15/347
2008/0264014 A1* 10/2008 Oh ..... A47L 9/108 55/423
2008/0264016 A1* 10/2008 Oh ..... A47L 5/28 55/429
2012/0255140 A1* 10/2012 Tomita ..... A47L 9/108 15/347
2013/0067681 A1* 3/2013 Hyun ..... A47L 5/28 15/347
2013/0312215 A1* 11/2013 Kim ..... A47L 9/22 15/347
2014/0130290 A1* 5/2014 Jang ..... A47L 9/108 15/319
2015/0107047 A1* 4/2015 Hyun ..... A47L 9/108 15/352

* cited by examiner

*Primary Examiner* — Robert Clemente

(57) ABSTRACT

A system for compacting debris collected within a robotic vacuum debris container to allow more space for incoming debris. The volume of collected debris is reduced by pressure plates pressing the debris against surfaces so that the debris container may hold a greater mass of debris. The system allows robotic vacuums to operate for longer periods of time before requiring maintenance by a user to empty the debris container.

3 Claims, 2 Drawing Sheets

DEBRIS COMPACTING SYSTEM FOR ROBOTIC VACUUMS

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described below, including methods and techniques. The disclosure described herein is directed generally to a system for compacting debris within a debris container of a robotic vacuum.

As understood herein, the term "robotic vacuum" may be defined generally to include one or more autonomous devices having communication, mobility, vacuuming and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a debris dustbin to store debris, a brush to facilitate collection of debris, and a means to spin the brush.

Generally, one or more plates are provided within a debris container of a robotic vacuum and are moved within the debris container against collected debris to decrease the volume of and thereby compress collected debris.

In the preferred embodiment, a plate is periodically propelled by an electric motor and set of gears along guiding tracks inside the debris container of a robotic vacuum.

Figure 1:
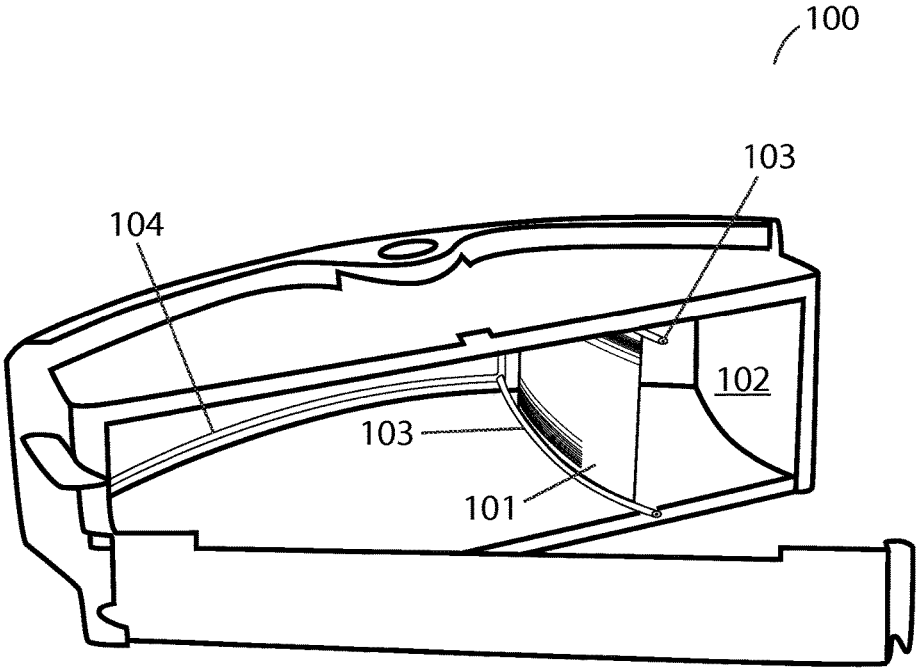

Referring to FIG. 1, a robotic vacuum debris container 100 is illustrated. A plate 101 is provided within the debris container to press debris against the walls 102 of the debris container to make more room for incoming debris. In some embodiments, a plurality of plates may be provided. In some embodiments, plates may press debris against other plates (rather than debris container walls) to compress debris. In some embodiments, plates may be made from rigid, inflexible materials. In some embodiments, plates may be made from flexible materials. The system is also provided with a means to guide plate movement. In the example shown, bars 103 at the top and bottom of the plate guide the plate along tracks 104 within the debris container. An electric motor (not shown) and gear set (not shown) power the movement of the plate. It should be noted that other methods of plate movement are possible without departing from the scope of the invention.

In some embodiments, plate movement may occur at regular intervals and be actuated by a timer.

In some embodiments, plate movement may be manually actuated by a user.

In some embodiments, plate movement may be actuated automatically by a debris sensor when the amount of debris detected within the debris container reaches a predetermined threshold.

In the preferred embodiment, the system further comprises a resistance sensor, which halts debris compression when resistance against the plate or plates reaches a predetermined threshold.

Figure 2A:
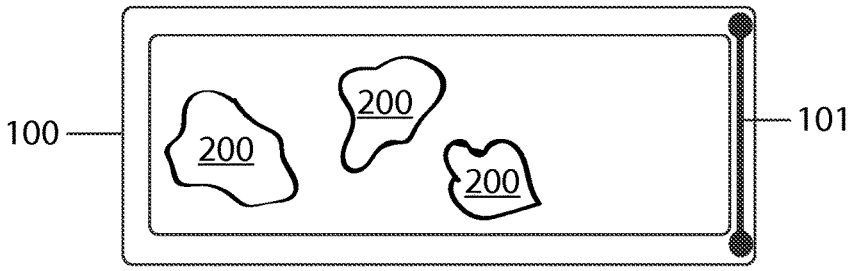
Figure 2B:
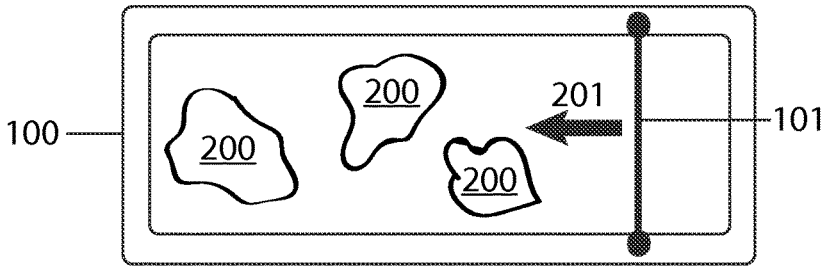
Figure 2C:
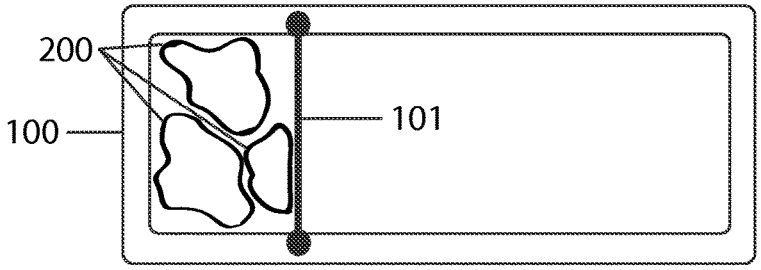
Figure 2D:
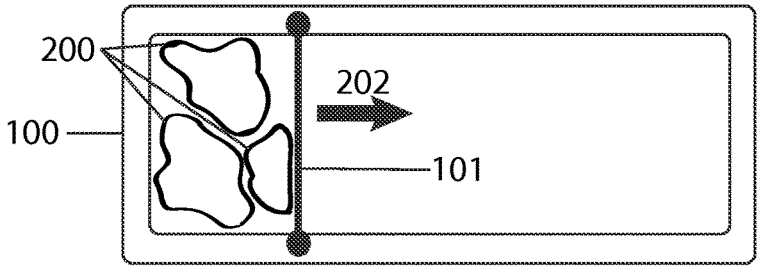

Referring to FIGS. 2A, 2B, 2C and 2D, an overhead view of one possible plate movement pattern is illustrated. As should be understood, numerous other plate movement patterns are possible without departing from the scope of the invention. Referring to FIG. 2A, in the example shown, the plate 101 starts at an initial position on a first side of the debris container 100. In this position, the plate has not yet compacted the debris 200 within the debris container. Referring to FIG. 2B, when plate movement is actuated, the plate 101 moves toward the opposite wall of the debris container 100 in a direction 201 to begin compacting the debris 200. In a next step illustrated in FIG. 2C, the plate 101 stops movement toward the opposite wall of the debris container 100 when resistance against the plate from the compacted debris 200 reaches a predetermined threshold. In a next step illustrated in FIG. 2D, the plate 101 moves in a direction 202 back to the original starting position on a first side of the debris container 100, leaving the debris 200 compacted.

In some embodiments, two or more plates may be provided to compress debris. The number of plates and the movement pattern of the plate or plates may vary and are not limited except by the practical limitations of the particular robotic vacuum debris container for which they are designed.

Plate movement is not limited to a direction perpendicular to the plane of the work surface; a plate could be devised to move vertically, compressing debris upward or downward, or in any other direction relative to the plane of the work surface.

We claim:

1. A robotic vacuum debris container comprising:

A debris container frame having a cavity defined therein to receive and store debris;

One or more plates disposed within said debris container for compressing stored debris;

A set of tracks disposed along the walls of said debris container cavity along which said one or more plates may be guided;

A set of notches or bars provided on said one or more plates and positioned within said tracks to guide said one or more plates along said tracks; and An electric motor and gear set to power movement of said one or more plates.

2. A method for compacting debris within a robotic vacuum debris container comprising:

Providing one or more pressure plates disposed within the robotic vacuum debris container;

powering said pressure plate(s) by an electric motor and gear set that propel said one or more pressure plates through a set of notches or bars provided thereon along a set of tracks disposed along the walls of said debris container;

such that, when activated, said one or more pressure plates compress debris within the robotic vacuum debris container by pressing said debris against one or more surfaces.

3. A system for compacting debris within a robotic vacuum debris container comprising:

one or more plates provided within the robotic vacuum debris container;

said one or more plates powered by an electric motor and gear set;

a set of tracks disposed along the walls of said debris container with a set of notches or bars provided on said one or more plates and positioned within said tracks;

whereby when the motor operates, it causes periodic movement of said one or more plates against debris within the robotic vacuum debris container compressing said debris.

* * * * *